US005215220A

United States Patent [19]

Kreiseder et al.

[11] Patent Number: 5,215,220

[45] Date of Patent: Jun. 1, 1993

[54] TAMPER EVIDENT CLOSURE WITH DISPENSING SPOUT AND INTEGRAL OPENING MEMBER

[75] Inventors: Walter J. Kreiseder, Barrington; Allen J. Vogel, Long Grove, both of Ill.

[73] Assignee: Courtesy Corporation, Wheeling, Ill.

[21] Appl. No.: 693,795

[22] Filed: Apr. 30, 1991

[51] Int. Cl.[5] ..... B67D 5/00

[52] U.S. Cl. ..... 222/83; 222/541; 222/548

[58] Field of Search ..... 222/81, 83, 521, 541, 222/507, 553, 548, 546; 220/253, 258, 267, 277

[56] References Cited

U.S. PATENT DOCUMENTS

| | | | |
|---|---|---|---|
| 2,404,879 | 7/1946 | Lateur | 220/267 |
| 3,263,874 | 8/1966 | Porter et al. | 222/541 |
| 3,357,605 | 12/1967 | Chadfield | 222/548 |
| 3,369,707 | 2/1968 | Porter et al. | 222/83 |
| 3,389,840 | 6/1968 | Musel et al. | 222/548 |
| 3,467,287 | 9/1969 | Marchant et al. | 222/548 |
| 4,258,867 | 3/1981 | Weiler et al. | 222/541 |
| 4,567,995 | 2/1986 | Kreiseder et al. | 222/83 |
| 4,653,672 | 3/1987 | Tuerk et al. | 222/553 |

FOREIGN PATENT DOCUMENTS

| | | | |
|---|---|---|---|
| 788685 | 10/1935 | France | 222/548 |
| 88931 | 6/1964 | France | 222/541 |
| 1407730 | 6/1965 | France | 222/83 |
| 86896 | 3/1966 | France | 222/541 |

*Primary Examiner*—Andres Kashnikow
*Assistant Examiner*—P. Derakshani
*Attorney, Agent, or Firm*—Silverman, Cass & Singer, Ltd.

[57] ABSTRACT

A closure for a container opening including an end cap member having a base portion and a spout portion integrally formed therewith and upstanding therefrom, where the spout portion includes a first aperture therethrough for directing the contents out of the container. A connecting member is included for connecting the base portion about the container opening as well as a plug member for closing off the first aperture where the plug member is upstanding from the spout portion and is secured about the periphery of the first aperture by a severable wall. A cover member also is included which is mounted to the end cap member for rotational movement with respect to the end cap member where the cover member includes a second aperture for receiving the plug member therethrough. A first portion of the inner wall defining the second aperture is formed by a knife edge capable of severing the severable wall upon rotational movement of the cover member to enable removal of the plug member and dispensing of the container contents through the first and second apertures of the closure in a desired position about the periphery of the container.

13 Claims, 2 Drawing Sheets

Fig. 1
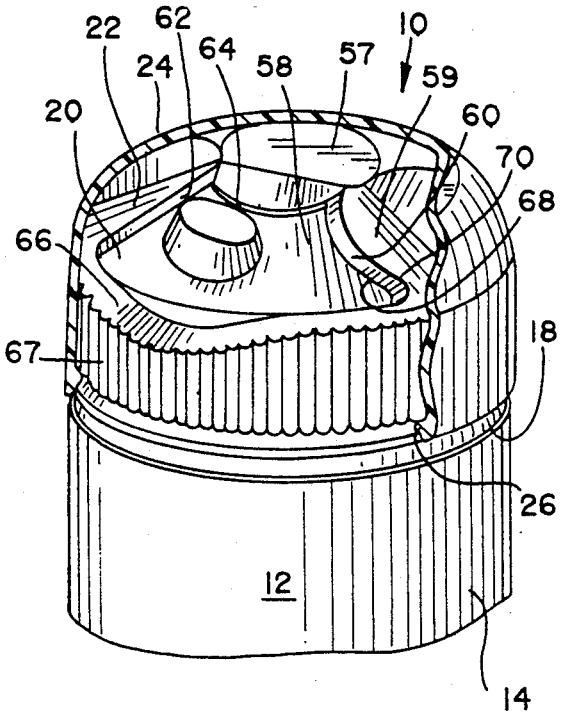
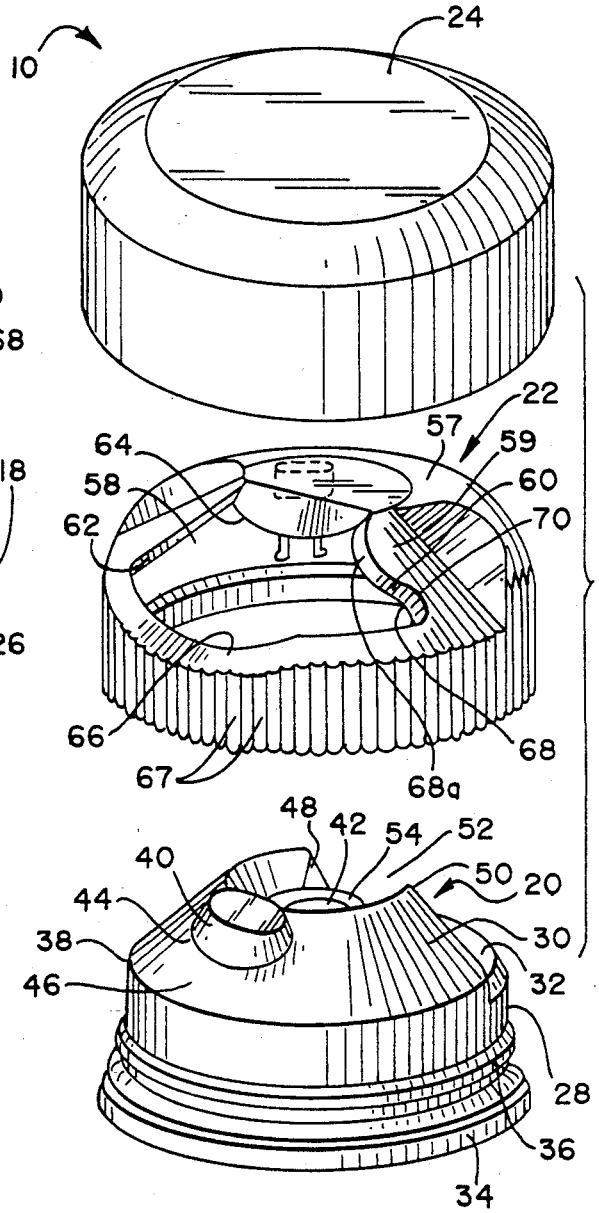
Fig. 3
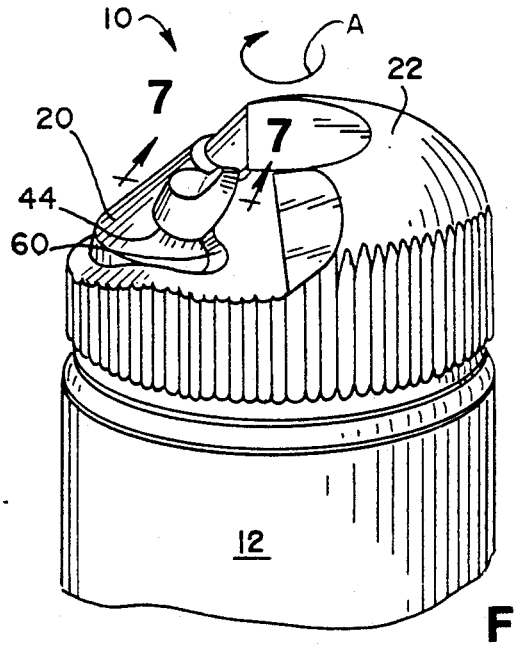
Fig. 2

Fig. 4
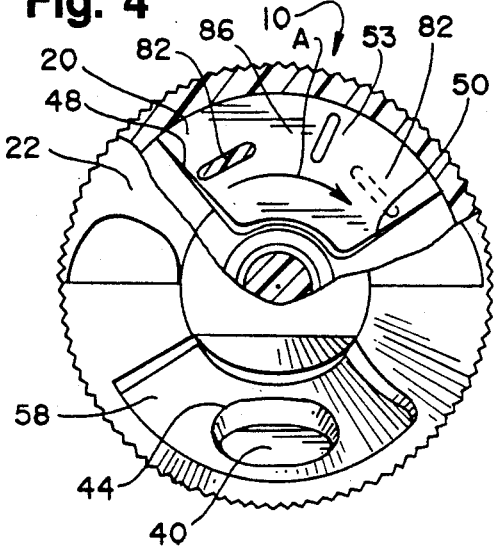
Fig. 5
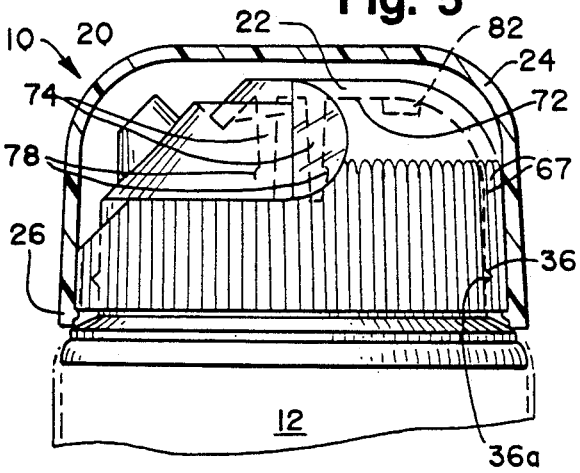
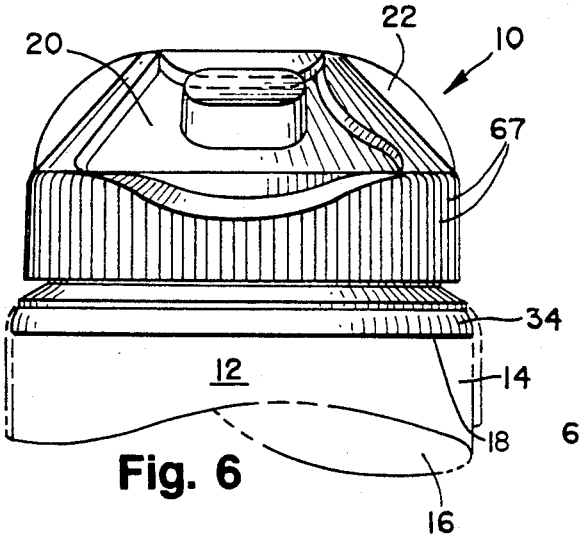
Fig. 6
Fig. 7
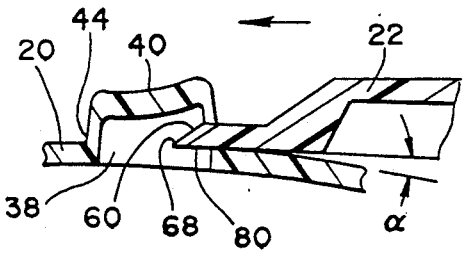
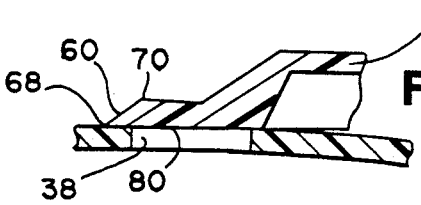
Fig. 8
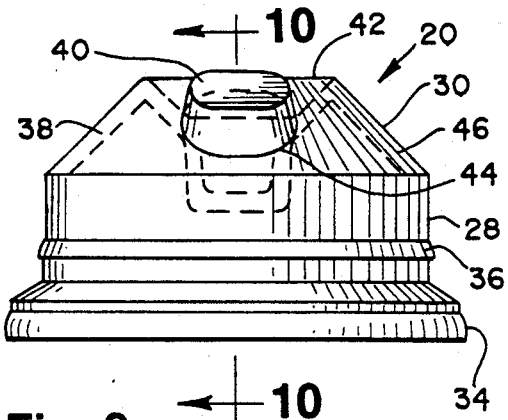
Fig. 9
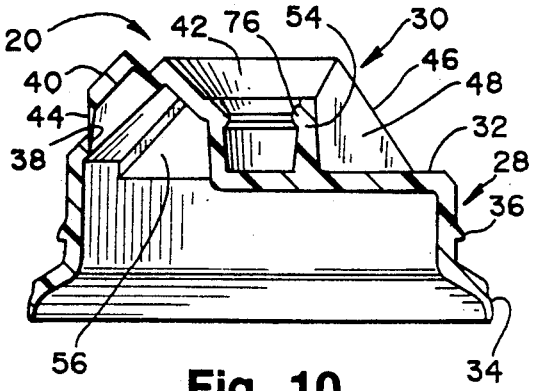
Fig. 10

TAMPER EVIDENT CLOSURE WITH DISPENSING SPOUT AND INTEGRAL OPENING MEMBER

BACKGROUND OF THE INVENTION

1. Field of the Invention

This invention relates generally to tamper evident end closure caps for containers, and more particularly to an end closure cap having a sealed dispensing spout where the cap can be manipulated to open the spout for initial use and reseal the spout for later use as well as indicating whether any tampering with the spout or closure has occurred before its initial use.

2. Description of the Related Art

Closures or end caps for containers typically are utilized to cover an open mouth on one end of a container and can be actuated to allow the contents of the container to be removed. In order to provide an indication to a consumer that the closure has been tampered with and the product within the container possibly tainted various types of tamper evident members have been utilized in conjunction with such closures.

One type of tamper evident closure provides a dispensing opening which initially is sealed and can be manipulated by a user to break the seal to obtain access to the contents within the container. An example of such a closure is disclosed in U.S. Pat. No. 4,567,995 which is assigned to the same assignee as the assignee herein. That closure includes a substantially circular end cap and complimentary cover rotatably connected to the end cap centrally and about their peripheries. The end cap includes a main part formed as a flat circular surface and a raised portion thereon connected to the flat surface by a thinned severable wall. The raised portion fits within an opening in the cover where a portion of the opening is formed as a knife edge. Upon rotation of the cover with respect to the end cap, the knife edge cuts through the severable wall to remove the raised portion from the container, thereby defining a pour opening in the flat surface of the end cap.

Some disadvantages of this type of closure are that it is designed for top dispensing only, no spout portion is provided to direct dispensing of the contents, the cover is freely rotatable with respect to the end cap in both directions, a seal is not provided between the opened aperture of the end cap and the cover and no positive indication of the position of the cover with respect to the end cap is provided.

It therefore is desirable to provide a tamper evident closure having a base end cap with a sealed integral dispensing spout and complimentary cover member where the cover member can be rotated about the end cap to break the seal and the contents within the container can be directed toward the opening and dispensed in a particular direction about the container. It also is desirable to provide such a closure where the rotation of the cover member is restricted to prevent improper positioning of the cover member as well as a positive indication of the position of the cover and a leak-proof seal between the cover member and the end cap.

SUMMARY OF THE INVENTION

The invention provides a closure for a container opening including an end cap member having a base portion where the base portion includes a spout portion integrally formed therewith and upstanding therefrom. The spout portion includes a first aperture therethrough for directing the contents out of the container and a connecting member is included for connecting the base portion about the container opening. A plug member is provided for closing off the first aperture where the plug member is upstanding from the spout portion of the base portion and is secured about the periphery of the first aperture by a severable wall. A cover member also is included which is mounted to the end cap member for rotational movement with respect to the end cap member where the cover member includes a second aperture for receiving the plug member therethrough. A first portion of the inner wall defining the second aperture is formed by a knife edge capable of severing the severable wall upon rotational movement of the cover member to enable removal of the plug member and dispensing of the container contents through the first and second apertures of the closure in a desired position about the periphery of the container.

BRIEF DESCRIPTION OF THE DRAWINGS

FIG. 1 is a perspective view of the closure of the invention connected to a container where the protective over cap is broken away to illustrate the end cap member and complimentary cover member;

FIG. 2 is a perspective view of the closure of the invention, similar to FIG. 1, without the protective over cap, illustrating the knife edge of the cover member cutting the severable wall member of the plug member on the spout portion;

FIG. 3 is an exploded perspective view of the closure of the invention illustrating the end cap member, cover member and protective over cap;

FIG. 4 is a top plan view of the closure of the invention, without the protective over cap, where a portion of the cover member is illustrated in partial section to illustrate the engagement members of the cover member and cooperating channel of the end cap member;

FIG. 5 is a side elevational view of the closure of the invention connected to a container with the protective over cap illustrated in cross-section and illustrating the mounting of the cover member to the end cap member in dotted outline;

FIG. 6 is a side elevational view of the closure of the invention connected to a container illustrating the position of the cover member with respect to the end cap member before removal of the plug member;

FIG. 7 is a cross-sectional view of the closure of the invention taken along the line 7—7 of FIG. 2, and in the direction indicated generally, illustrating the knife edge of the cover member during cutting of the severable wall of the plug member;

FIG. 8 is a cross-sectional view of the closure of the invention, similar to FIG. 7, illustrating the sealed position of the cover member with respect to the end cap member;

FIG. 9 is a side elevational view of the end cap member of the closure of the invention; and FIG. 10 is a cross-sectional view of the base end cap of the closure of the invention taken along line 10—10 of FIG. 9, and in the direction indicated generally, illustrating the details of the spout portion and the mounting recess of the base end cap.

DESCRIPTION OF THE PREFERRED EMBODIMENTS

Referring to FIG. 1, the closure of the invention is designated generally by the reference numeral 10. The closure 10 is substantially cylindrical in configuration and typically is utilized in conjunction with a container 12.

The container 12 also preferably is cylindrical in configuration and includes a top end 14 and a closed bottom end (not illustrated). As FIG. 6 illustrates, the container 12 includes an interior portion 16 and the top end 14 is formed as an open mouth 18 which is covered and sealed by the closure 10. It is to be understood that the particular size, shape and material of the container 12 can vary. Furthermore the closed bottom end of the container 12, as well as the container 12 itself, can be formed in a variety of ways including forming the container 12 as a deformable tube where the bottom end is crimped closed, such as tubes which typically are utilized for toothpaste, glue and the like.

The closure 10 can be connected to the container 12 in a removable or non-removable manner. Preferably the closure 10 is snap-fit onto the container 12, but can be threadingly engaged or integrally formed with the container 12 or can be connected in a variety of other ways including by a force fit, crimping or with an adhesive. The particular connection between the closure 10 and container 12 is not illustrated in detail and can vary so long as a leak-proof connection is established therebetween.

Preferably, the closure 10 is made of plastic and is of a simple design so that it readily can be molded in an injection type molding process. The construction, material and molding process of the closure 10, however, can vary.

As FIG. 3 illustrates, the closure 10 preferably includes an end cap member 20, complimentary cover member 22 and protective over cap member 24. The cover member 22 is reciprocally and rotatably mounted to the end cap 20 as will be explained in detail below.

As FIGS. 1 and 5 illustrate, to connect the over cap 24 to the closure 10, the over cap 24 includes an annular rib 26 formed on its interior surface. The rib 26 engages with the bottom of the cover member 22 for a snap-type connection so that the over cap 24 readily can be removed from and reinstalled on the closure 10 as desired. Preferably, the over cap 24 is formed from transparent plastic, but can be formed from any desired material and with any desired color.

As FIGS. 3, 9 and 10 illustrate, the end cap 20 includes a base portion 28 and a spout portion 30 upstanding from a top semi-circular planar surface 32 on the base portion 28 of the end cap 20. To assist in connecting the base portion 28 to the container 12 as explained above, the base portion 28 includes a depending skirt 34. To assist in rotatably connecting the cover member 22 to the peripheral edge of the base portion 28 of the end cap 20, an annular peripheral rib 36 can be formed on the outside surface of the base portion 28 which snaps into a complimentary annular recess **36*a* (FIG. 5) formed on the inside surface of the cover member 22. The primary connection between the end cap 20 and the cover member 22** will be described in detail below.

The spout portion 30 is integrally formed with the base portion 28 upstanding from the planar surface 32 and substantially has a semi-circular conical configuration. The spout portion 30 includes an aperture 38, plug member 40 and a tapered annular recess 42, where the aperture 38 and plug member 40 preferably are formed with a substantially oval configuration.

The plug member 40 is connected about the periphery of the aperture 38 by a severable wall 44 to seal the aperture 38 and maintain the contents within the container 12 until the contents are to be dispensed. As will be described in detail below, the severable wall 44 will be cut upon manipulation of the cover member 22 to remove the plug member 40 and enable dispensing of the contents through the aperture 38.

As FIG. 3 illustrates, the spout portion 30 preferably is defined by a conical surface 46 which extends about a predetermined portion of the end cap 20 and terminates at first and second end walls 48 and 50. Preferably, to provide dispensing of the contents from the container 12 at a position between the side of the container 12 and the base portion 28 of the end cap 20, the aperture 38 extends through the conical surface 46 of the spout portion 30. This provides side dispensing of the container contents which is easier and more desirable for a user, as opposed to top dispensing, since it enables a precise dispensing of the contents in a desired position.

The conical surface 46 preferably is formed at an angle of approximately 45 degrees with respect to the planar surface 32 of the base portion 28 and extends approximately 240 degrees about the end cap 20 leaving a output or channel portion 52 between the first and second end walls 48 and 50 of the conical surface 46 which extends about the remaining 120 degrees of the end cap 20. The channel portion 52 is open on its top and outside surfaces and is defined on its ends by the first and second end walls 48 and 50 and on its bottom by the top planar surface 32 of the base portion 28. An annular sleeve or bushing 54, which forms the bottom of the annular recess 42, defines the curved interior side of the channel portion 52.

As FIG. 10 illustrates, the inside of the spout portion 38 provides a dispensing or funnel area 56 formed between the inside surface of the conical surface 46 and the bushing 54. During dispensing of the contents, the funnel area 56 assists in feeding the contents within the container 12 toward the aperture 38 to be dispensed at a precise position. If desired, to further assist in directing the contents within the container 12 toward the aperture 38, the inside surface of the conical surface 46 can be sloped toward the aperture 38 (not illustrated).

As FIGS. 1 and 3 illustrate, the cover member 22 is closed on one end by a top 57 and includes an aperture 58 through a conical portion 59 which the plug member 40 extends when the cover member 22 is mounted to the end cap 20. The inside surface of the conical portion 59 is dimensioned for close engagement with the conical surface 46 of the spout portion 30. The aperture 58 is formed with a predetermined shape and extends over a predetermined portion of the periphery of the cover member 22 within the conical portion 59. Preferably, the aperture 58 is somewhat rectangular in shape and is defined by right and left side wall members 60 and 62 and top and bottom wall members 64 and 66, respectively. To assist in grasping and turning the cover member 22 by a user, the outside surface of the cover member 22 can include knurls 67.

To cut the severable wall 44 which connects the plug member 40 to the aperture 38 of the end cap 20, the right side wall member 60 of the aperture 58 of the cover member 22 preferably is formed as a knife edge. Thus, the right side wall member 60 is tapered outward from an inside edge 68 to an outside edge 70 so that the inside edge 68 forms a relatively sharp cutting edge.

To decrease the force necessary to cut the severable wall 44, the knife edge can be non-linear, as FIG. 3 illustrates, which distributes the cutting area over a larger segment of the knife edge. Preferably, the knife edge includes a semi-circular portion 68*a* which substantially provides concentrated point contact with the severable wall 44.

As FIG. 5 illustrates, to form the primary rotatable connection between the end cap 20 and cover member 22, the cover member 22 includes an inside top surface 72 from which one or more resilient prongs 74 depend into the interior of the cover member 22. During assembly, the prongs 74 are inserted within the annular recess 42 of the end cap 20 and engage the inner walls of the bushing 54 forming the bottom of the annular recess 42. Preferably, as FIG. 10 illustrates, to assist in such engagement, the inner wall of the bushing 54 can be formed with an inwardly projecting annular rib 76 and the prongs 74 can be formed to include barbs 78. Thus, the barbs 78 seat below the annular rib 76 within the bushing 54 during assembly as described below.

Briefly, in operation, FIG. 1 illustrates the initial unopened position of the closure 10. In this position, the cover member 22 is rotatably connected to the end cap 20 with the plug member 40 extending through the aperture 58 in the cover member 22. With reference to FIG. 2, upon clockwise rotation of the cover member 22 with respect to the end cap 20 in the direction of arrow "A", the knife edge side wall 60 of the aperture 58 begins to cut the severable wall 44 of the plug member 40. Upon continued rotation in the direction of arrow "A", the remainder of the severable wall 44 is cut and, at the same time, the plug member 40 is forced upward along the tapered portion of the knife edge. With cutting completed, the plug member 40 is removed from engagement with the end cap 20.

Thereafter, to enable dispensing of the contents from the container 20, the cover member 22 is rotated counter clockwise opposite the direction of arrow "A". This enables the knife edge side wall 60 to be retracted back across the area formerly occupied by the plug member 40 to expose the aperture 38 in the end cap 20 and allow the contents to be dispensed from the container 12.

Since the plug member 40 is integrally formed with the end cap 20, which in turn is secured to the container 12, the container contents cannot be dispensed without removing the plug member 40 or breaking part of the severable wall 44. This structure provides the desired tamper-evident feature of the closure 10.

Preferably, the cover member 22 and end cap 20 are formed and dimensioned to provide sealing of the aperture 38 after removal of the plug member 40. As FIGS. 7 and 8 illustrate, the cover member 22 includes an inside sealing surface 80 which specifically is dimensioned to complement and be in close engagement with the conical surface 46 of the end cap 20. Thus, when the cover member 22 is rotated to completely cut off the plug member 40, the sealing surface 80 extends completely across and seals off the aperture 38 in the end cap 20, as FIG. 8 illustrates, to prevent the contents from being dispensed from the container 12.

Preferably, to assist in providing a leak proof seal between the sealing surface 80 and the conical surface 46, the sealing surface 80 is formed with a slight angle $\alpha$ with respect to the conical surface 46. This slight angle $\alpha$ provides a force which increases upon rotation in the direction of arrow "A" and is concentrated at the area of the sealing surface 80 to assist in providing the desired seal.

As FIGS. 4 and 5 illustrate, to provide limited rotational movement of the cover member 22 with respect to the end cap 20, the inside top surface 72 of the cover member 22 includes a depending projection 82. When the closure 10 is assembled, the projection 82 is seated within the channel 52 in the end cap 20 between the first and second end walls 48 and 50 which define the channel 52. As FIG. 4 illustrates, when the projection 82 is in contact with the first end wall 48, the aperture 58 in the cover member 22 is positioned about the plug member 40 and aperture 38 of the end cap 20.

Upon clockwise rotation of the cover member 22 in the direction of arrow "A" the projection 82 moves to the position shown in dotted outline to contact the second end wall 50 of the channel 52. This position would be the closed or sealed position of the cover member 22. Thus, rotation of the cover member 22 is limited about a predetermined distance, which is an arc of a circle, defined by the first and second end walls 48 and 50.

It is to be noted that the engagement of the projection 82 with the first and second end walls 48 and 50 provides a discrete positive indication or "feel" to a user during rotation. This positive indication enables a user to determine, without looking, whether the closure 10 has been positioned in its fully opened or fully closed position.

The closure 10 provides dispensing in a fully open position as well as a plurality of intermediate dispensing positions by positioning the knife edge 60 to cover a desired portion of the aperture 38. Furthermore, if desired, the channel 52 can include at least one engagement or detent member 86 positioned between the first and second end walls 48 and 50 for contact with the projection 82. The detent member 86 readily can be overridden by the projection 82 during rotation and can be positioned so that at contact the closure is in a desired intermediate dispensing position. This provides a positive indication for a user during rotation that the closure has been positioned in an intermediate position.

To assemble the closure 10, the cover member 22 is positioned over the end cap 20 and the prongs 74 of the cover member 22 are aligned with the annular recess 42 and bushing 54 of the end cap 20. The cover member 22 then is forced toward the end cap 20 so that the prongs 74 seat beneath the rib 76 within the bushing 54. At the same time, to assist in connection of the periphery of the cover member 22, the cover member 22 is forced over the annular rib 36 on the outside surface of the end cap 20 so that the rib 36 seats within the recess 36*a*. The over cap 24 then can be connected to the cover member 22 by snapping the rib 26 over the bottom of the cover member 22.

Modifications and variations of the present invention are possible in light of the above teachings. A specific dimension, material or construction is not required so long as the assembled device is able to function as herein described. It is therefore to be understood that within the scope of the appended claims, the invention may be practiced otherwise than as specifically described.

What is claimed and desired to be secured by Letters Patent of the United States is:

1. A closure for a container opening comprising:

an end cap member having a semi-circular planar base portion, said base portion extending across a predetermined portion of the container opening and including a tapered spout portion integrally formed therewith and upstanding therefrom, said spout portion including a first aperture therethrough for directing the contents out of the container;

means for connecting said base portion about the container opening;

a plug member for closing off said first aperture, said plug member upstanding from said spout portion and being secured about the periphery of said first aperture by severable wall means;

a cover member mounted to said end cap member for rotational movement with respect to said end cap member, said cover member including a second aperture for receiving said plug member therethrough, a first portion of an inner wall defining said second aperture being formed by knife means capable of severing said severable wall means upon rotational movement of said cover member to enable removal of said plug member and dispensing of the container contents through said first and second apertures of said closure in a desired position about the periphery of the container; and sealing means integrally formed with said cover member for sealing said first aperture upon continued rotation of said cover member after said plug member is removed and for providing increased sealing pressure against said first aperture upon further rotation of said cover member.

2. The closure as defined in claim 1 including engagement means between said end cap member and said cover member for enabling limited rotational movement therebetween within a predetermined distance, said distance being sufficient for severing said wall means while restricting rotational movement in both directions between said cover member and said end cap member outside of said predetermined distance.

3. The closure as defined in claim 1 wherein said base portion of said end cap member and said cover member have substantially circular cross-sectional configurations, said upstanding spout portion being formed as a semi-circular cone, said first aperture and complimentary plug member being positioned on a predetermined portion of said cone.

4. A closure for a container opening comprising:

a substantially cylindrical end cap having a semi-circular planar base portion extending across a predetermined portion of the container opening and a semi-circular conical spout portion integrally formed with and upstanding from a first side of said base portion, said conical spout portion including a first aperture therethrough for directing the contents out of the container;

connecting means integral with said base portion for attaching said end cap member about the container opening;

a plug member for closing off said first aperture, said plug member upstanding from said conical spout portion and being secured about the periphery of said first aperture by severable wall means;

a substantially cylindrical cover member mounted to said end cap member for rotational movement with respect to said end cap member, said cover member being closed at a first end by a top wall and having a portion of a side wall formed as a semi-cylindrical conical surface for cooperation with said conical spout portion of said end cap member, said conical surface including a second aperture for receiving said plug member therethrough, a first portion of an inner wall defining said second aperture being formed by knife means capable of severing said severable wall means upon rotational movement of said cover member to enable removal of said plug member and dispensing of the container contents through said first and second apertures of said closure in a desired position about the periphery of the container and;

sealing means integrally formed with said cover member for sealing said first aperture upon continued rotation of said cover member after said plug member is removed and for providing increased sealing pressure against said first aperture upon further rotation of said cover member.

5. The closure as defined in claim 4 wherein said sealing means includes an engagement portion of an inside wall of said conical surface of said cover member formed proximate said knife means for sealing engagement with said first aperture.

6. The closure as defined in claim 4 wherein said knife means are provided by tapering said wall defining said second aperture from an inside to an outside surface of said cover member.

7. The closure as defined in claim 4 including engagement means between said end cap member and said cover member for enabling limited rotational movement therebetween within a predetermined distance, said distance being sufficient for severing said wall means while restricting rotational movement in both directions between said cover member and said end cap member outside of said predetermined distance.

8. The closure as defined in claim 7 wherein said engagement means include a depending projection formed on the inside surface of said top wall of said cover member for engagement within a complimentary channel formed in said end cap member.

9. The closure as fined in claim 8 wherein said channel includes two opposite end walls for abutment by said projection to provide the desired limited movement and a positive indication to a user of an opened and closed position of the first aperture.

10. The closure as defined in claim 4 wherein said cover member is reciprocally and rotatable mounted to said end cap by at least one resilient prong member depending from the center of the inside surface of said top wall of said cover member and is snappingly engaged within a central annular recess formed in said end cap member.

11. The closure as defined in claim 10 further including auxiliary mounting means formed as a portion of the interior side wall of said cylindrical cover member for rotational engagement with an exterior peripheral surface of said annular base portion of said end cap member.

12. A closure for a container opening comprising:

a substantially cylindrical end cap member having an annular base portion and a semi-circular conical spout portion integrally formed with and upstanding from a first side of said base portion, said conical spout portion including a first aperture therethrough for directing the contents out of the container;

connecting means integral with said base portion for attaching said end cap member about the container opening;

a plug member for closing off said first aperture, said plug member upstanding from said conical spout portion and being secured about the periphery of said first aperture by severable wall means; and a substantially cylindrical cover member mounted to said end cap member for rotational movement with respect to said end cap member, said cover member being closed at a first end by a top wall and having a portion of a side wall formed as a semi-cylindrical conical surface for cooperation with said conical spout portion of said end cap member, said conical surface including a second aperture for receiving said plug member therethrough, a first portion of an inner wall defining said second aperture being formed by knife means capable of severing said severable wall means upon rotational movement of said cover member to enable removal of said plug member and dispensing of the container contents through said first and second apertures of said closure in a desired position about the periphery of the container, said cover member further including means for sealing said first aperture after said plug is removed including an engagement portion of an inside wall of said conical surface of said cover member formed proximate said knife means for sealing engagement with said first aperture, said engagement portion having a substantially conical shape of a different angle with respect to said conical spout portion to provide an increased sealing pressure against said first aperture.

13. A closure for a container opening comprising:

an end cap member having a base portion, said base portion including a spout portion integrally formed therewith and upstanding therefrom, said spout portion including a first aperture therethrough for direction the contents out of the container;

means for connecting said base portion about the container opening;

a plug member for closing off said first aperture, said plug member upstanding from said spout portion and being secured about the periphery of said first aperture by severable wall means;

a cover member mounted to said end cap member for rotational movement with respect to said end cap member, said cover member including a second aperture for receiving said plug member therethrough, a first portion of an inner wall defining said second aperture being formed by a knife means capable of severing said severable wall means upon rotational movement of said cover member to enable removal of said plug member and dispensing of the container contents through said first and second apertures of said closure in a desired position about the periphery of the container; and sealing means integrally formed with said cover member for sealing said first aperture upon continued rotation of said cover member after said plug member is removed and for providing increased sealing pressure against said first aperture upon further rotation of said cover member.

* * * * *

UNITED STATES PATENT AND TRADEMARK OFFICE

CERTIFICATE OF CORRECTION

PATENT NO. : 5,215,220

DATED : June 1, 1993

INVENTOR(S) : Walter J. Kreiseder and Allen J. Vogel

It is certified that error appears in the above-identified patent and that said Letters Patent is hereby corrected as shown below:

Column 3, Line 23, "Preferably" insert a comma (,);

Column 4, line 28, change "output" to --cutout--;

Column 10, line 6, change "direction" to --directing--;

Column 10, line 18, delete "a".

Signed and Sealed this

Tenth Day of May, 1994

Bruce Lehman

*Attest:*

BRUCE LEHMAN

*Attesting Officer*

*Commissioner of Patents and Trademarks*